US006435849B1

(12) United States Patent
Guilmette

(10) Patent No.: US 6,435,849 B1
(45) Date of Patent: Aug. 20, 2002

(54) FLUID PUMP

(76) Inventor: Paul L. Guilmette, P. O. Box 13, Canton Center, CT (US) 06020

( * ) Notice: Subject to any disclaimer, the term of this patent is extended or adjusted under 35 U.S.C. 154(b) by 0 days.

(21) Appl. No.: 09/663,177

(22) Filed: Sep. 15, 2000

(51) Int. Cl.[7] ..... F04B 43/00

(52) U.S. Cl. ..... 417/472; 417/330; 60/398; 60/497; 92/34

(58) Field of Search ..... 417/472, 330, 417/331, 473; 60/497, 498, 499, 501, 506, 398; 92/34, 44

(56) References Cited

U.S. PATENT DOCUMENTS

| | | | | |
|---|---|---|---|---|
| 238,639 A | | 3/1881 | Boerner | |
| 3,118,596 A | | 1/1964 | Saile | 230/160 |
| 3,598,505 A | * | 8/1971 | Greene et al. | 417/330 |
| 3,618,390 A | | 11/1971 | Frick | 73/398 C |
| 3,961,863 A | * | 6/1976 | Hooper, III | 417/334 |
| 4,012,178 A | | 3/1977 | Puckett | 417/478 |
| 4,373,867 A | | 2/1983 | Campbell | 417/90 |
| 4,448,020 A | * | 5/1984 | Wood et al. | 60/398 |
| 4,523,903 A | | 6/1985 | Arens | 417/489 |
| 4,953,490 A | | 9/1990 | Smith | 114/183 |
| 5,044,295 A | * | 9/1991 | Shimokawa | 114/183 A |
| 5,346,369 A | * | 9/1994 | Miller, Jr. | 417/211 |
| 5,381,675 A | | 1/1995 | Siegel | 62/498 |
| 5,564,143 A | | 10/1996 | Pekar et al. | 5/708 |
| 5,842,838 A | * | 12/1998 | Berg | 417/331 |

FOREIGN PATENT DOCUMENTS

| | | |
|---|---|---|
| DE | 2 344 530 | 3/1974 |

* cited by examiner

*Primary Examiner*—Michael Koczo
*Assistant Examiner*—Han L Liu
(74) *Attorney, Agent, or Firm*—Libert & Associates

(57) ABSTRACT

A pump (10) comprises a pair of bladders (28,30) attached to respective opposite sides of a flexure plate (32) for pumping fluid by alternately compressing and expanding the bladders. Each bladder has at least one input connector (22, 34) with a one-way valve (38) therein and at least one output connector (24, 36) with a one-way valve (40) therein, in order to provide one-way flow of fluid through each of the bladders. The pump (10) is positioned to be acted upon by a moving liquid, such as natural wave action of a body of water, for example, by being connected to floating objects on the surface. The moving liquid causes the flexure plate (32) to bend in an undulate manner, first in one direction and then in the other. This bending action causes fluid to be alternately drawn into and expelled from the bladders as the bladders are alternately expanded and compressed. Alternatively, one end of the flexure plate (32) of the pump (10) may be attached to a stable object such as a dock and the other end to a floating object such as a boat. Alternate embodiments of the pump (107, 136) may operate as a fender pump or a bilge pump.

30 Claims, 8 Drawing Sheets

FLUID PUMP

BACKGROUND OF THE INVENTION

1. Field of the Invention

The present invention concerns the pumping of fluids from a fluid source to a fluid container by means of a pump apparatus and, in particular, relates to the pump apparatus being driven by natural forces.

2. Related Art

The use of fluid pumps having flexible wall(s) which are driven in a repetitive manner for moving fluid is illustrated, for example, in the following references which are incorporated by reference herein:

U.S. Pat. No. 238,639, issued to Boemer on Mar. 8, 1881 and entitled "Air Pump", discloses in FIG. 3 a pair of pump bodies in a vertical position having an inlet valve f and an outlet valve g having a one-way valve therein. A flexible wall in each of the pump bodies faces the other and a cam causes pivoting of arms E to press on the flexible walls, alternately, to cause air to be pumped into or through the pump bodies. As noted in this patent, the flexible walls C are biased in the expanded position as made so that when the flexing arm E is removed, the flexible walls will expand themselves and draw in fluid through an input one-way valve. FIGS. 1 and 2 illustrate another embodiment wherein a horizontal pump body A has a single flexible wall which is biased inwards of the pump body A. As the pump body A rotates about the horizontal axis, weighted balls force the flexible wall outwardly which draws in air through one of a pair of one-way valves. As the pump body rotates the flexible wall to the vertical position, the wall returns to its naturally biased position forcing out the air. The pump is designed to pump air into a water tank from outside.

U.S. Pat. No. 4,373,867, issued to Campbell on Feb. 15, 1983 and entitled "Pressure Charged Airlift Pump", illustrates a water pump in FIG. 2 which is air driven. The pump is positioned in the bottom of an oil well to remove water and loose mud therefrom. An auxiliary pump 62 is driven by high-pressure air in the plenum 55. The operator mechanism 80 causes a pair of diaphragms 64, 66 to alternately inflate/deflate. These diaphragms 64, 66 act directly upon a pair of flexible hose sections 68, 70 with one-way valves 82, 88 on each end. By pressing on the flexible hose sections, water is forced upwardly and upon release of the diaphragrns, the hose sections 68, 70 expand and draw in more water and mud.

SUMMARY OF THE INVENTION

Generally, the present invention provides a pump for pumping a fluid by action of a moving liquid which imposes a repetitive driving force on the pump. The pump comprises at least one bladder with a flexure plate operably connected to the at least one bladder and being sufficiently flexible to bend and recover in response to the respective driving force. The pump further has at least one fluid input connector operably connected to the bladder and having a one-way valve therein to admit fluid into the bladder upon expansion of the bladder and at least one fluid output connector operably connected to the bladder and having a one-way valve therein to pass fluid out of the bladder upon compression of the bladder whereby the repetitive driving force causes the flexure plate to bend and recover in a manner which causes the bladder connected thereto to be repetitively expanded and contracted to pump fluid.

In a related aspect of the present invention, the pump is formed by at least one accordion-like bellows section having opposite closed ends where a pumping volume is defined by a wall with the bellow pleats of the accordion-like bellows section. The closed ends are attached to the pleats and the flexure plate.

In a further related aspect of the present invention, the pump comprises two bladders, each bladder being attached to a respective opposite side of the flexure plate, whereby one bladder is expanded and the other is simultaneously compressed by bending of the flexure plate.

Further, the present invention provides a method of pumping a fluid utilizing a pump which comprises at least one bladder, a flexure plate operably connected to the at least one bladder and flexible enough to bend in response to the driving force, at least one fluid input connector operably connected to the bladder and having a one-way valve therein to admit fluid into the bladder upon expansion of the bladder and at least one fluid output connector operably connected to the bladder and having a one-way valve therein to pass fluid out of the bladder upon compression of the bladder, whereby the driving force causes the flexure plate to bend in a manner which causes the bladder connected thereto to repetitively be expanded and contracted to pump fluid, the method comprising bending the flexure plate repetitively in opposite directions to alternately expand and contract the bladder to thereby impose a pumping action on fluid alternately taken into and expelled from the bladder.

In a related aspect of the present invention, the method includes two bladders, which are positioned on respective opposite sides of the flexure plate, and the method comprises compressing one bladder while simultaneously expanding the other.

In accordance with another aspect of the present invention, a pump for pumping a fluid by action of a moving liquid imposes a repetitive driving force on a driving object which operates on the pump to pump the fluid. The pump comprises at least one resilient, deformable bladder, at least one fluid input connector operably connected to the bladder and having a one-way valve therein to admit fluid into the bladder upon expansion of the bladder and at least one fluid output connector operably connected to the bladder and having a one-way valve therein to pass fluid out of the bladder upon compression of the bladder. Also included is at least one connector for attaching the pump to an external object whereby the repetitive driving force causes the driving object to act upon the resilient, deformable bladder to be repetitively expanded and contracted to pump fluid.

In a related aspect of the present invention, the pump comprises a bladder having an accordion-like bellows section having first and second ends, the bellows section defining a pumping volume. A first end cover and a second end cover are attached to the bellows section first and second ends.

A further aspect of the present invention provides a method of pumping a fluid utilizing a pump comprising at least one bladder having a resilient, deformable wall defining a pumping volume and flexible enough to bend in response to a driving object biased by the driving force, at least one fluid input connector operably connected to the bladder and having a one-way valve therein to admit fluid into the bladder upon expansion of the bladder and at least one fluid output connector operably connected to the bladder and having a one-way valve therein to pass fluid out of the bladder upon compression of the bladder, whereby the driving object causes the wall of the bladder to bend in a manner which causes the bladder connected thereto to repetitively be expanded and contracted to pump fluid, the method comprising bending the wall repetitively in opposite directions to alternately expand and contract the bladder to thereby impose a pumping action on fluid alternately taken into and expelled from the bladder.

These and many other objects and advantages of the present invention will be readily apparent to one skilled in the pertinent art from the following detailed description of a preferred embodiment of the invention and the related drawings.

DETAILED DESCRIPTION OF THE INVENTION AND PREFERRED EMBODIMENTS THEREOF

Figure 1:
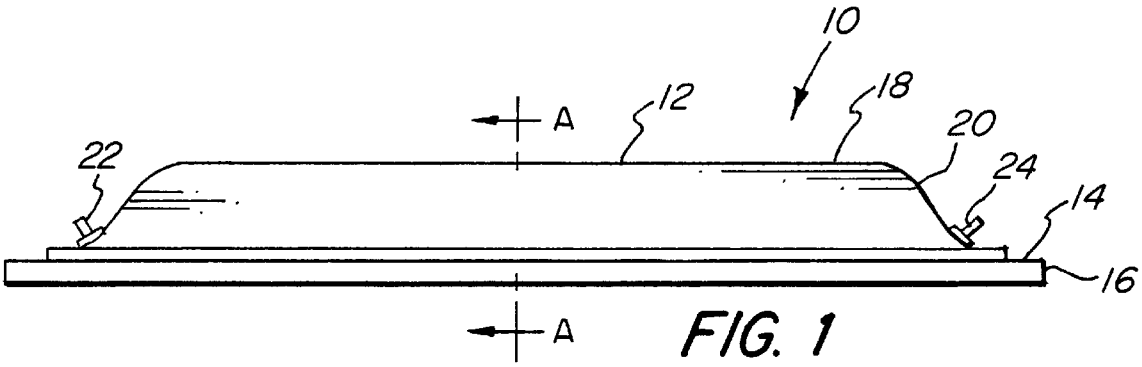
FIG. 1 is a side view of a top bladder of the pump of the present invention.

Referring to FIG. 1, a pump 10 of the present invention includes at least one flexible bladder, a top bladder 12, being mounted on a top side 14 of a flexure plate 16 for pumping fluid by compression and expansion of the bladder in an alternating manner. The top bladder 12 is made of a flexible material like rubber and has an outer wall 18 and side walls 20 of integral construction. The shape of the bladder may be rectangular, cylindrical or other shape and is preformed and biased to that preformed shape. The flexure plate 16 may also be made of a rubber type material, plastic, and even metal. The flexure plate 16 must be dimensioned and configured so as to bend in an undulating manner when acted upon by a natural driving force. Although wave action in an ocean environment is the preferable natural driving force, the pump 10 may be placed in other environments where bending of the flexure plate 16 occurs such as inside a bilge of a ship or other storage containers where one side of the pump is attached to a relatively stable structure and the water therein moves as a result of the ship rolling in the ocean.

It is further possible to mount the pump 10 in a vertical position rather than horizontal position if the natural driving force acts in this manner. For example, if one end of the pump 10 was fixedly mounted to a static structure near a beach, the incoming and outgoing surf may be used to bend the flexure plate 16. In this environment, the whole pump would be submerged and attached to the static structure and would face the incoming and outgoing surf.

The bladder 12 has one fluid input connector 22 and a fluid output connector 24. The fluid input connector 22 and the fluid output connector 24 may include therein one-way valves, not shown in greater detail, but are of conventional design, so that fluid flows through the bladder 12 only in one direction. The one-way valves may be attached to the hoses that are mounted onto the fluid input connector 22 and the fluid output connector 24 and therefore may not be a part of the pump of the present invention although they are required for the present invention to function properly. The end of the hose not connected onto the fluid input connector 22 is placed in a first position for taking in a fluid, such as oil, from an oil spill. The other end of the hose connected onto the fluid output connector 24 is placed in a second position being the collecting container for the fluid being pumped by the pump 10. This may be a barge, a ship holding tank, or any container suitable for storage of the fluid being transferred.

Figure 7:
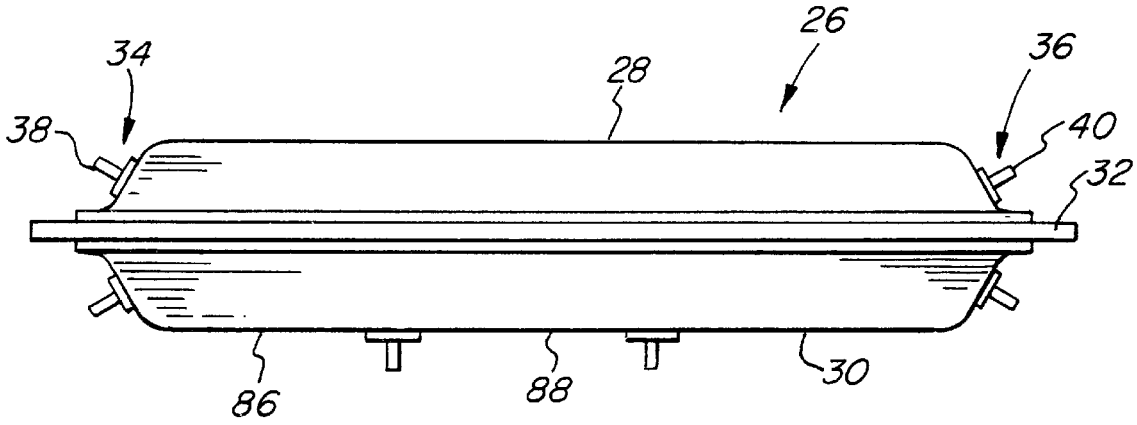
FIG. 7 is a side view of the pump of another embodiment showing the first bladder, the top bladder, and the second bladder, the bottom bladder, mounted upon the flexure plate with the fluid input and the fluid output connectors in the bladders.

Although the pump 10 as shown in FIG. 1 has only one top bladder 12, the preferred pump 26 as seen in FIG. 7 has the top bladder 28 and a bottom bladder 30 mounted on opposite sides of the flexure plate 32. Each bladder has at least one fluid input connector 34 with optionally a one-way valve 38 therein and has at least one fluid output connector 36 with, optionally, a one-way valve 40 therein in order to provide one-way flow of fluid through each of the bladders 28 and 30.

Figure 2:
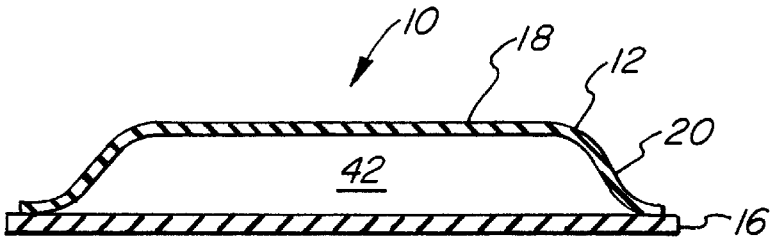
FIG. 2 is a cross-sectional view taken along line (A—A) of the pump of FIG. 1.
Figure 10:
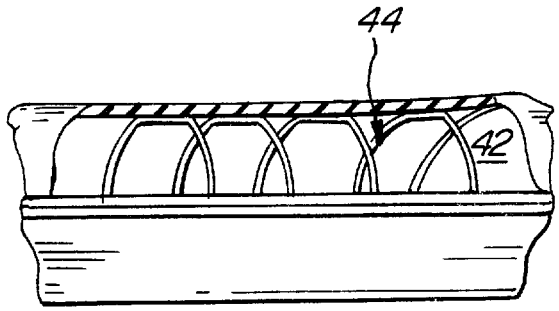
FIG. 10 illustrates by partial cross section the interior chamber of a bladder having a flexible wire structure for supporting the bladder walls thereabout.

A cross-sectional view of the pump 10 is shown in FIG. 2 wherein a chamber 42 is formed between the bladder 12 and the flexure plate 16. The bladder 12 may be formed in the configuration shown and may be self-supporting, but other devices may be used to provide support to the bladder 12 such as a flexible wire structure 44 shown in FIG. 10.

Figure 3:
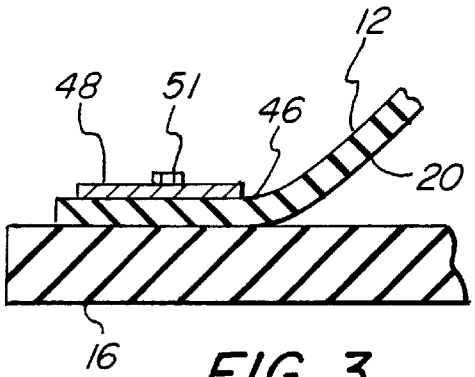
FIG. 3 is a partial cross section of a joint between the flexure plate and the bladder.
Figure 18:
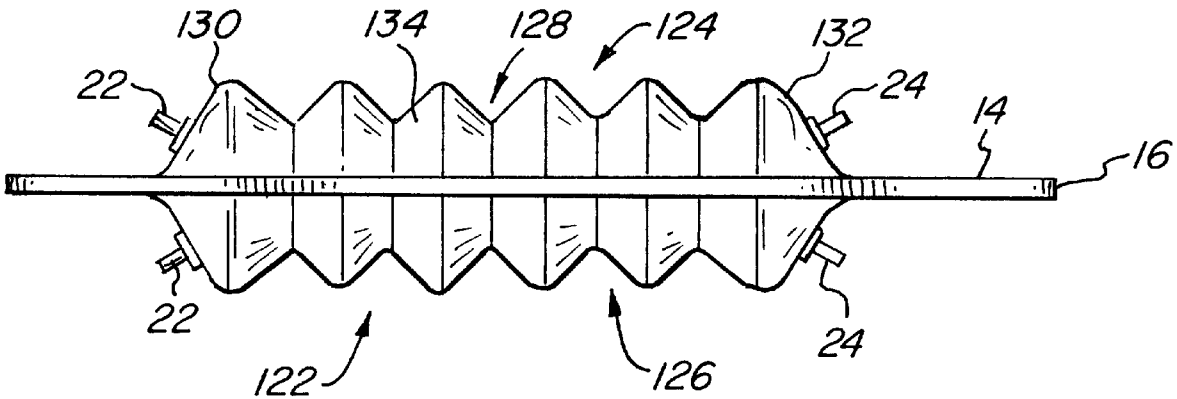
FIG. 18 is a side view of a pump according to another embodiment showing the outer wall and side walls as an accordion-like bellows section as compared to FIG. 7.

FIG. 18 illustrates a bellows pump 122 having a top bladder 124 and a bottom bladder 126 attached to the flexure plate 16. As see therein, each bladder is formed having an accordion-like bellows section 128 with a plurality of pleats therein and a pair of closed ends 130, 132 which, together with the flexure plate 16, form a pumping volume 134. Each bladder would be attached to the flexure plate 16 as shown in FIG. 3 or in any other manner to insure an airtight seal between the bladders and the plate 16. The pleats would be made of heavy, flexible rubber or the like and would be resilient to return to the form shown in FIG. 18 after deformation. Appropriate fluid connectors with one-way valves therein are attached to the bladders as in FIG. 1.

FIG. 3 illustrates an embodiment of attaching the bladder 12 to the flexure plate 16. The side walls 20 have an integral base flange 46 extending in a horizontal manner from the side walls 20. A sufficient area on the flange 46 is provided so that a flange plate 48 may be secured by a bolt 51, only one shown, to the flexure plate 16 with the flange 46 therebetween and in a sealed manner.

Figure 4:
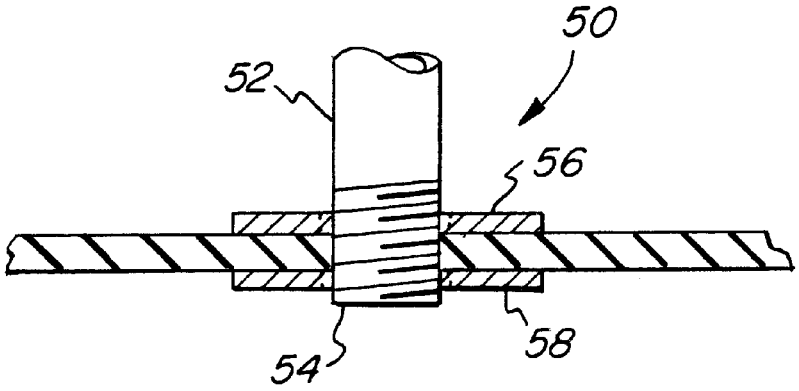
FIG. 4 is a partial cross section of an outlet connector in the bladder wall.

FIG. 4 illustrates a fluid input connector 50 having a connector pipe 52 with threads on an insertion end 54. Threaded washers 56 and 58 are attached on the connector pipe 52 so that the bladder wall 60 is sealed therebetween. A one-way valve may be attached on the insertion end 54, inside the connector pipe 52, or on the hose.

Figure 12:
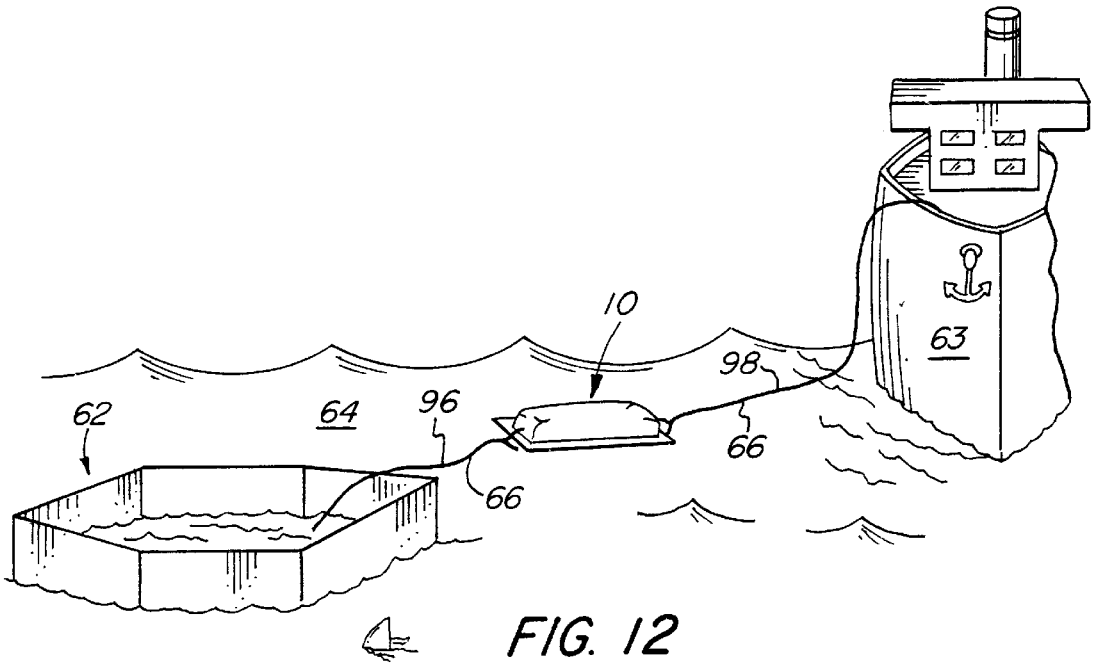
FIG. 12 illustrates the pump upon the ocean surface for transferring oil from an oil spill to a ship.

Referring to FIG. 12, the pump 10 may be used for pumping a fluid such as oil from a first container 62 in which it is collected to a second container such as a storage container upon a ship 63. The pump 10 is placed on, or connected to, a moving medium such as the ocean surface 64, which causes the flexure plate 16 (FIG. 7) to bend in an undulate manner. This action causes fluid to be drawn into, and pushed out of, the bladders appropriately. One bladder pumps while the other one fills. The pump may be placed in the ocean near the first container and connected to the storage container by hoses 66. Fluid input lines 96 and the fluid output lines 98 may be joined together so that there is almost continuous pumping action by the pump 10 if there are multiple inputs. Only one input line 96 and one output line 98 are shown.

Figure 9:
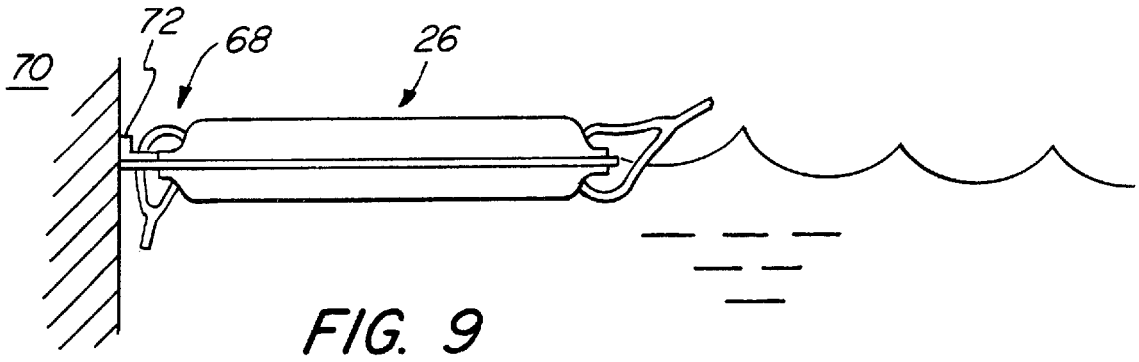
FIG. 9 is a side view of the pump of FIG. 7 showing one end of the pump connected to a relatively stable structure with wave action affecting the other end of the pump.

Referring to FIG. 9, one end 68 of the pump 26 may be attached to a relatively stable object 70 such as a dock, ship, float, buoy, etc. A bracket 72 may be attached to the stable object 70 and to the one end 68 in order to prevent the movement of the end 68. As the wave action interacts upon the pump 26, the fluid is moved from the first container to the storage container.

Figure 8:
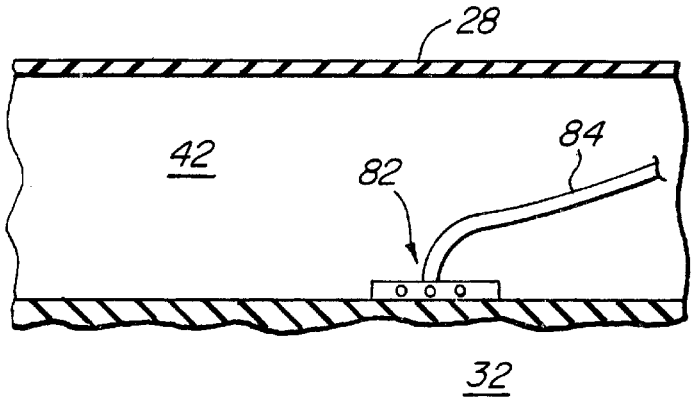
FIG. 8 is a partial cross-sectional view showing an intake device on top of the flexure plate with a hose thereon running to a fluid output connector in the wall of the bladder.

The one-way valves may operate upon a liquid or fluid such as air and thus priming of the pump is not required. In order to be able to drain the pump of any liquid, an intake device 82 (FIG. 8) located in a top chamber 42 must be located at the lowest point therein and is connected to an outlet in the pump 26 by an internal hose 84.

Figure 13:
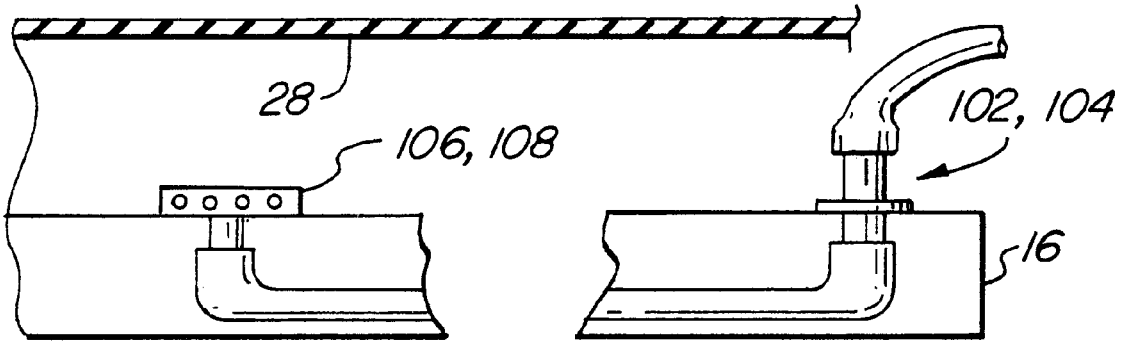
FIG. 13 is a cross-sectional view of a fluid intake device connected to a fluid output connector as a part of the flexure plate of the pump of the present invention for use in the top bladder.

In another embodiment (FIG. 13), in the top bladder 28, a fluid input connector 102 and fluid output connector 104 may be connected to the flexure plate 16 which would further be connected to an output and intake device 106 and 108, respectively. In the bottom bladder 30 (FIG. 14), an intake device 110 must be located on or about the bladder outer wall 88 so as to be able to remove liquid remaining on the outer wall 88. The output connector thereto may be attached to the flexure plate 16, not shown.

Figure 5:
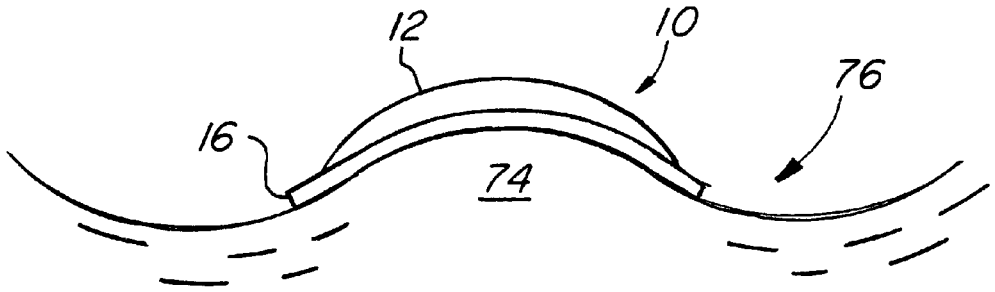
FIG. 5 is a side view of the pump of FIG. 1 in the pump mode wherein the flexure plate has a convex shape in the direction of the top bladder due to wave action.
Figure 6:
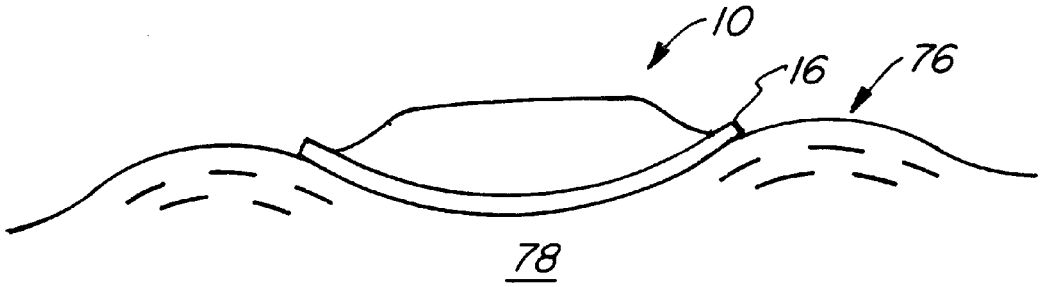
FIG. 6 is a side view of the pump of FIG. 1 in the intake mode wherein the flexure plate has a concave shape in the direction of the top bladder due to wave action.

FIG. 5 illustrates the pump 10 riding a crest 74 of a wave 76 and bending in a convex manner which causes the bladder 12 to be pulled closer to the flexure plate 16 and thus expelling any air and/or fluid therein. FIG. 6 illustrates the pump 10 riding in a trough 78 of a wave 76 which causes the flexure plate 16 to bend in a concave manner which expands the volume of the chamber 42 (FIG. 2), to draw in air and/or fluid. Therefore, the shape of the pump 10, i.e., its length versus its width, if rectangular, is important. If its length is much greater than its width, then the orientation of the pump 10 in the ocean is critical to successful operation. The length must be sufficient so that the flexure plate 16 bends in the waves. If the flexure plate 16 is not of sufficient length, it will ride over the wave without bending. Therefore, the mounting of the pump 10 is critical when the waves come from one direction. If the pump 10 is square or round, this will not be a problem, but it still must bend in the waves considered. The waves in a bay versus the open ocean are clearly different and would thus require a different design since the wave action may be insufficient to bend the flexure plate 16.

Figure 14:
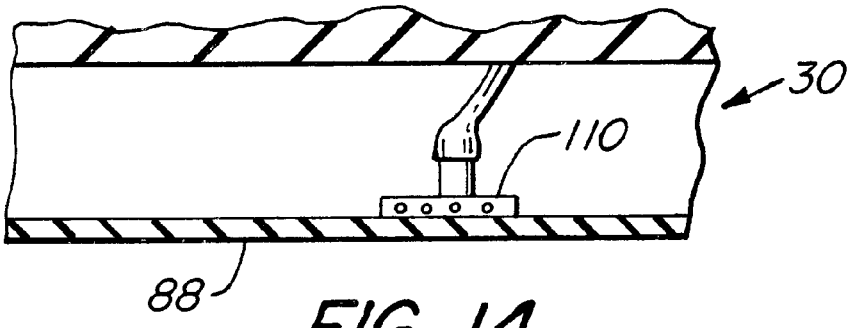
FIG. 14 is a cross-sectional view of a fluid intake device located on the bottom bladder outer wall.

In order to remove residual fluid from the pump 26, a fluid intake device 82 (FIG. 8) is mounted to the upper surface of the flexure plate 32. The fluid intake device 82 is connected to the fluid output connector 40 (FIG. 7) by means of a hose 84. The fluid intake device 82 should be mounted near the lowest point to which fluid flows on the top side of the flexure plate 16. As to the bottom bladder 30, the fluid intake device 82 may be attached to the outer wall 88 as shown in FIG. 14.

Figure 11:
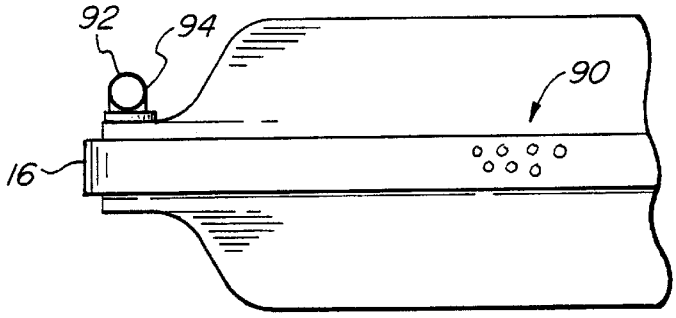
FIG. 11 is a side view of a flotation device of the present invention attached on the outer circumference of the pump.

Referring to FIG. 11, the pump may have a flotation material 90 within the flexure plate 16. Further, a flotation device 92 such as a flexible tube 94 may be used on the pump to maintain a sufficient flotation position.

Figure 15A:
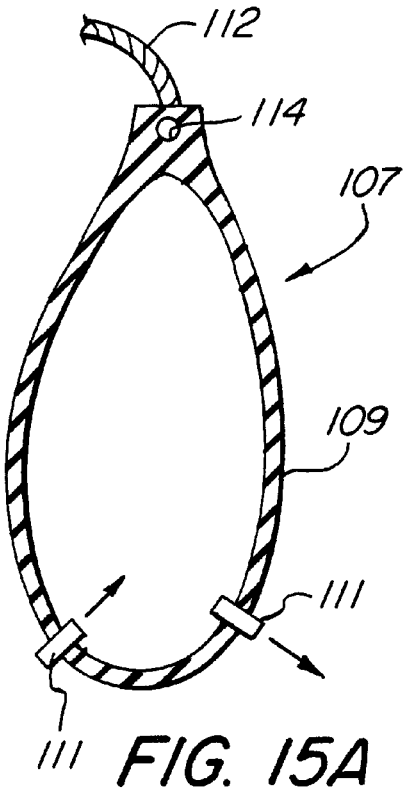
FIGS. 15A and 15B illustrate a cross-sectional view through a boat fender pump in an unexpanded state and a partially collapsed state.
Figure 15B:
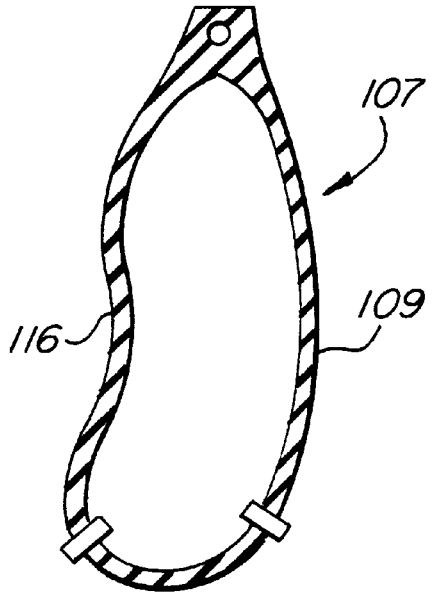
Figure 16:
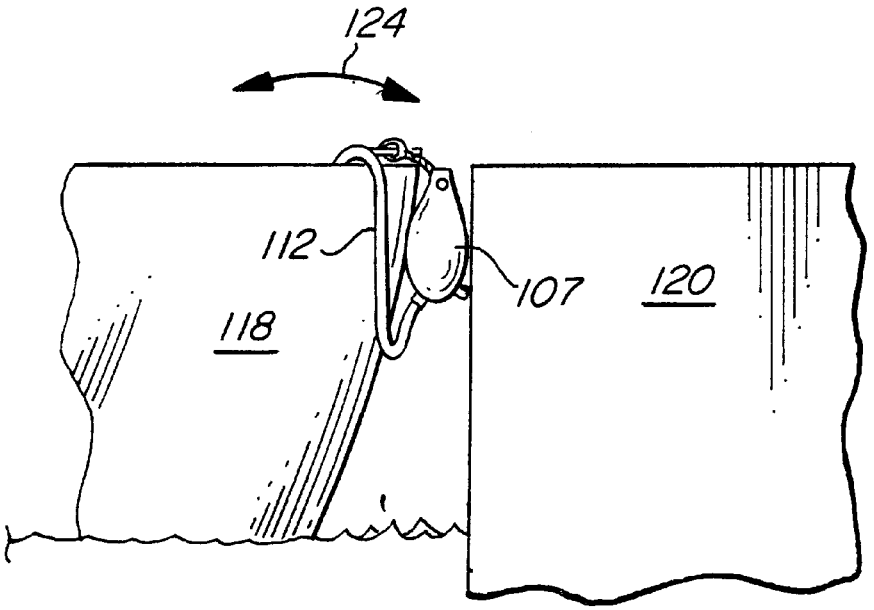
FIG. 16 illustrates a partial view of the boat, the pier, and the boat fender pump between the boat and the pier.

Referring to FIGS. 15A and 15B, a fender pump 107 is shown. FIG. 15A is a cross-sectional view of the fender pump 107. The fender pump 107 is made of a flexible material like rubber and has a resilient preformed shell 109 such as shown. Fluid input and output connectors 111 with one-way valves therein insure that the fluid is only pumped in a one-way manner. An eyehole 114 allows the fender pump 107 to be tied to a boat by a rope 112. As the boat rocks back and forth, the side of the boat pushes on a flexure wall 116 of the fender pump 107 as shown in FIG. 15B. FIG. 16 illustrates the use of the fender pump 107 attached to a boat 118, partially shown, with a hose 112 running to a bilge therein. The rocking action 124 causes the fender pump 107 to deflate and inflate when the boat 118 pushes it against dock 120, thus providing the force to operate the pump.

Figure 17:
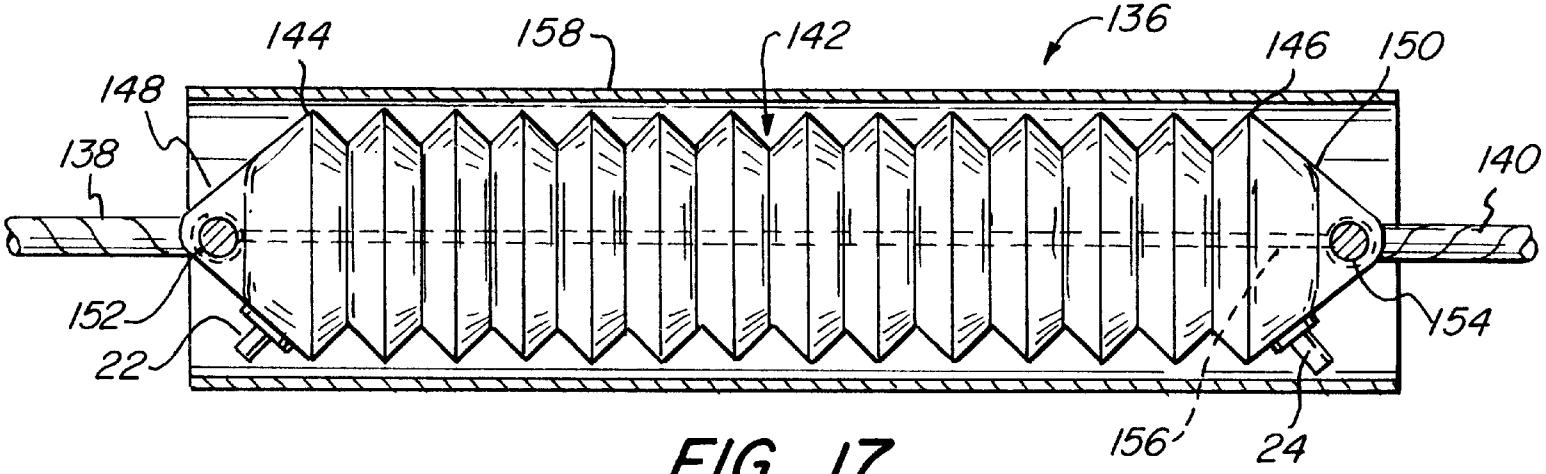
FIG. 17 illustrates a pump as a bilge pump for a boat.

FIG. 17 illustrates an embodiment of a bilge pump 136 that may be connected between the boat 118 and the pier 120 (FIG. 16) by means of lines 138, 140. An accordion-like bellows section 142 is made of a plurality of pleats of heavy rubber or the like. The bellows section 142 may have a circular cross section. The bellows section 142 has a first and second end 144, 146, respectively, that are attached to a first end cover 148 and a second end cover 150, respectively. Eyelets 152 and 154 are a part of the end covers to which the lines 138, 140 are attached. Appropriate fluid input and output connectors 22, 24 are attached to the pump 136.

In order to prevent the over-extension of the bellows section 142, an internal device like a steel cable 156 is attached to the eyelets. In its normal condition, the cable 156 would be slack and a sufficient amount of slack cable would be provided to allow the bellows section 142 to translate about a neutral position to cause pumping action by expanding and contracting of the bellows section 142. The cable 156 may prevent undue sagging of the bellows section 142 when filled with fluid or an external device, such as a tube 158, may be placed about the bellows section 142 and would allow the bellows section 142 to translate freely therein.

In operation, the boat 118 is moored to the pier 120 by various lines with appropriate fender bumpers therebetween to allow the boat 118 to move as a result of tidal action and wave action. The bilge pump 136 would be tied between the boat 118 and the dock 120 by the lines 138, 140 such that the tension therein would elongate the bellows section 142 to a neutral position and thus rocking action of the boat 118 by wave action/tidal action would cause the bellows section 142 to expand or contract and thus appropriately pump fluid therethrough.

While the invention has been described in detail with respect to specific preferred embodiments thereof, numerous modifications to these specific embodiments will occur to those skilled in the art upon a reading and understanding of the foregoing description; such modifications are embraced within the scope of the appended claims.

What is claimed is:

1. A pump for pumping a fluid by action of a moving liquid which imposes a repetitive driving force on the pump, the pump comprising:

a flexure plate sufficiently flexible to bend and recover in response to the repetitive driving force;

at least one bladder connected to the flexure plate;

at least one fluid input connector operably connected to the bladder and having a one-way valve therein to admit fluid into the bladder upon expansion of the bladder; and at least one fluid output connector operably connected to the bladder and having a one-way valve therein to pass fluid out of the bladder upon compression of the bladder;

the bladder and flexure plate being configured so that repetitive bending and recovery of the flexure plate causes the bladder to be repetitively expanded and contracted to pump fluid.

2. The pump of claim 1 wherein the bladder has opposite ends and the flexure plate extends beyond the bladder at each opposite end.

3. The pump of claim 1 wherein the bladder is formed by at least one accordion-like bellows section having opposite closed ends, a pumping volume is defined by a wall with bellow pleats, the closed ends attached to the pleats and the flexure plate.

4. The pump of claim 1 wherein the driving force repetitively bends the flexure plate in opposite directions to alternately expand and compress the bladder.

5. The pump of claim 1 wherein the driving force is wave action.

6. The pump of claim 2 comprising two bladders attached to respective opposite sides of the flexure plate.

7. The pump of claim 2 wherein the flexure plate further comprises flotation means attached thereto.

8. The pump of claim 2 wherein the flexure plate further comprises fluid input and output means.

9. The pump of claim 2 comprising two bladders, each bladder being attached to a respective opposite side of the flexure plate, whereby one bladder is expanded and the other is simultaneously compressed by bending of the flexure plate.

10. The pump of claim 2 or claim 9 wherein a flexible structure is located within each bladder, the flexible structure providing support to the bladder to maintain the bladder in a predetermined shape when not being acted upon by the driving force.

11. A method of pumping a fluid utilizing a bellows pump, comprising a flexure plate flexible enough to bend in response to a driving force, at least one bladder connected to the flexure plate, at least one fluid input connector operably connected to the bladder and having a one-way valve therein to admit fluid into the bladder upon expansion of the bladder and at least one fluid output connector operably connected to the bladder and having a one-way valve therein to pass fluid out of the bladder upon compression of the bladder, the bladder and flexure plate being configured so that repetitive bending and recovery of the flexure plate causes the bladder connected thereto to repetitively be expanded and contracted to pump fluid, the method comprising bending the flexure plate repetitively in opposite directions to alternately expand and contract the bladder to thereby impose a pumping action on fluid alternately taken into and expelled from the bladder.

12. The method of claim 11 wherein the pump comprises two bladders.

13. The method of claim 12 wherein the bladders are positioned on respective opposite sides of the flexure plate and the method comprises compressing one bladder while simultaneously expanding the other.

14. The method of claim 11 including the step of utilizing the action of a liquid to provide a driving force to repetitively bend the flexure plate.

15. The method of claim 14 wherein the liquid is a body of water.

16. The method of claim 15 wherein the driving force is provided by a wave action of the body of water.

17. The method of claim 15 further comprising connecting the flexure plate of the pump between an object floating on the body of water and a fixed object.

18. The method of claim 15 further comprising connecting the flexure plate of the pump between two objects floating on the body of water.

19. The method of claim 15 further comprising mounting the pump within a moving body of water.

20. A pump for pumping a fluid by action of a moving liquid which imposes a repetitive driving force on a driving object which operates on the bellows pump to pump the fluid, the bellows pump comprising:

at least one resilient, deformable bladder;

at least one fluid input connector operably connected to the bladder and having a one-way valve therein to admit fluid into the bladder upon expansion of the bladder; and at least one fluid output connector operably connected to the bladder and having a one-way valve therein to pass fluid out of the bladder upon compression of the bladder;

at least one connector for attaching the bellows pump to external objects;

whereby the repetitive driving force causes the driving object to act upon at least one bladder to cause it to expand and contract to pump fluid through the bladder; and wherein the driving object is the side of a boat or a line between the pump and a boat.

21. The pump of claim 20 wherein the driving force repetitively causes the driving object to operate on the bladder to alternately expand and contract.

22. The pump of claim 20 wherein the driving force is wave action.

23. The pump of claim 20 comprising a bladder having an accordion-like bellows section having first and second ends, the bellows section defining a pumping volume, a first end cover and a second end cover attached to the bellows section first and second ends.

24. The pump of claim 23 further comprising means for limiting the extension of the bellows section.

25. The pump of claim 23 further comprising an internal support member for the bladder.

26. A method of pumping a fluid utilizing a pump, comprising at least one bladder having a resilient, deformable wall defining a pumping volume and flexible enough to bend in response to a driving object biased by a driving force, at least one fluid input connector operably connected to the bladder and having a one-way valve therein to admit fluid into the bladder upon expansion of the bladder and at least one fluid output connector operably connected to the bladder and having a one-way valve therein to pass fluid out of the bladder upon compression of the bladder, whereby the driving object causes the wall of the bladder to bend in a manner which causes the bladder connected thereto to repetitively be expanded and contracted to pump fluid, the method comprising:

bending the wall repetitively in opposite directions to alternately expand and contract the bladder to thereby impose a pumping action on fluid alternately taken into and expelled from the bladder;

utilizing the action of a body of water to provide a biasing action to the driving object which repetitively bends the wall of the bladder; and positioning the bladder of the pump between an object floating on the body of water and a fixed object.

27. A method of pumping a fluid utilizing a pump, comprising at least one bladder having a resilient, deformable wall defining a pumping volume and flexible enough to bend in response to a driving object biased by a driving force, at least one fluid input connector operably connected to the bladder and having a one-way valve therein to admit fluid into the bladder upon expansion of the bladder and at least one fluid output connector operably connected to the bladder and having a one-way valve therein to pass fluid out of the bladder upon compression of the bladder, whereby the driving object causes the wall of the bladder to bend in a manner which causes the bladder connected thereto to repetitively be expanded and contracted to pump fluid, the method comprising:

bending the wall repetitively in opposite directions to alternately expand and contract the bladder to thereby impose a pumping action on fluid alternately taken into and expelled from the bladder;

utilizing the action of a body of water to provide a biasing action to the driving object which repetitively bends the wall of the bladder; and positioning the bladder of the pump between two objects floating on the body of water.

28. The method of claim 26 wherein the bladder is connected between the object floating and the fixed object.

29. The pump of claim 23 further comprising an external support member for the bladder.

30. The pump of claim 23 further comprising a cable extending between the first and second ends of the bellows section.

* * * * *